United States Patent [19]

Krause

[11] 4,324,115

[45] Apr. 13, 1982

[54] FLATBED KNITTING MACHINE WITH PULSE GENERATOR FOR ELECTRONIC CONTROL

[75] Inventor: Erich Krause, Bopfingen, Fed. Rep. of Germany

[73] Assignee: Universal Maschinenfabrik Dr. Rudolf Schieber GmbH & Co. KG, Westhausen, Fed. Rep. of Germany

[21] Appl. No.: 149,879

[22] Filed: May 14, 1980

[30] Foreign Application Priority Data

May 14, 1979 [DE] Fed. Rep. of Germany ..... 2919369

[51] Int. Cl.[3] ..... D04B 7/00; D04B 15/66

[52] U.S. Cl. ..... 66/75.2

[58] Field of Search ..... 66/75.2, 232, 231

[56] References Cited

U.S. PATENT DOCUMENTS

| | | | |
|---|---|---|---|
| 3,670,527 | 6/1972 | Bourgeois | 66/232 |
| 3,817,059 | 6/1974 | Krause | 66/75.2 |
| 3,896,638 | 7/1975 | Gottschall et al. | 66/232 |
| 3,953,988 | 5/1976 | Gloeckler | 66/75.2 |
| 3,983,718 | 10/1976 | Kahan et al. | 66/75.2 |

FOREIGN PATENT DOCUMENTS

| | | | |
|---|---|---|---|
| 2203528 | 9/1972 | Fed. Rep. of Germany | 66/75.2 |
| 2617717 | 11/1976 | Fed. Rep. of Germany | 66/75.2 |

*Primary Examiner*—Ronald Feldbaum

*Attorney, Agent, or Firm*—Sughrue, Mion, Zinn, Macpeak and Seas

[57] ABSTRACT

As the carriage of a flatbed knitting machine traverses the needle bed, a pulse generator which comprises a toothed disc and two cycle signallers at its circumference produces pulses in synchronism with the carriage movement and corresponding to the needle cycle for electronic control of the machine. The toothed disc has a tooth pitch which corresponds in whole number multiples with the pitch of the needles in the bed. The pulse generator may be located on the machine frame or on the carriage. In the former case the carriage can have a pick-up which entrains a chain stretched on the machine frame with the toothed disc rotatable jointly with one of the sprocket wheels for the chain. In the latter case the toothed disc, carried by the carriage may be rotated by a coupled pinion which meshes with a rack stationary on the frame and co-extensive with the traverse of the carriage. In each case the pulse generator produces synchronized control pulses without direct scanning of the needles in the bed.

3 Claims, 6 Drawing Figures

1
2
3
4
5
6
7
8
9
10
11
12
13
14

1
2
3
4
5
15
16
17

FLATBED KNITTING MACHINE WITH PULSE GENERATOR FOR ELECTRONIC CONTROL

FIELD OF THE INVENTION

This invention relates to flatbed knitting machines having a cam carriage movable back and forth over the needle bed and having a pulse generator which comprises a pulse-initiating disc and two cycle signallers at the circumference of the disc and which produces pulses corresponding to the needle cycle for the electronic control of the machine.

DESCRIPTION OF THE PRIOR ART

One such, hand-operated, flatbed knitting machine is described for example in U.S. Pat. No. 3,983,718. The pulse generator is there arranged on the carriage and is driven in synchronism with the movement of the carriage through the intermediary of a gear system.

In electronically controlled flatbed knitting machines with a reciprocating cam carriage it is necessary that the traversing of the needles by the carriage is signalled back to the sequencing control means truly and accurately in accordance with the needle cycle. In a further known flatbed knitting machine one or more detectors are located on the carriage which directly sense the grooves in the needle bed, or the ribs between them, which are of course located at needle pitch spacing. However, particularly with a fine needle pitch, it is difficult to produce a utilisable signal which will clearly differentiate between the ribs and the grooves in the needle bed. The discrimination between a rib and a groove in the needle bed is small, and the distance between the detectors of the needle cycle signaller and the needle bed must be small in order, primarily to produce usable signals. Considerable problems of adjustment of the distance between needle cycle signaller or carriage and the needle bed arise because of this, especially because of the fact that the flutuations of the distance between needle cycle signaller and needle bed during the use of the flatbed knitting machine may only be small. A needle cycle signaller arranged in such a way at only a small distance from the needle bed is also very much endangered by a breakage of the needles or jacks. Furthermore, in a flatbed knitting machine of this type, the working zone of the needle cycle signaller is smaller than the carriage stroke, the working zone being the zone in which the control system evaluates the first and last needle bed groove or the corresponding rib in the needle bed in order to produce control signals for the needle selectors of the cam system, so that the full number of needles can be controlled having regard to the rack position of the needle bed.

With high capacity flatbed knitting machines with reciprocating cam carriages, the distance between the shafts of the sprocket wheels for the chain which drives the carriage is made so short that at the two ends of the needle bed the reversal of the carriage pick-up and consequently a change in the speed of the carriage takes place with the driving chain moving at constant speed. If one was to drive the pulse generator from this chain which drives the carriage, although it would indeed drive in synchronism with the sequence of the needle bed grooves in the central region of the needle bed, it would however drive the pulse generator asynchronously at the end regions of the needle bed, and this would lead to an erroneous information output to the control. Furthermore, the weight of the returned carriage would lead at least to a small yielding of the driving chain, leading to a further inaccuracy in the driving of the pulse generator if it was driven from the chain driving the carriage. Consequently, driving the pulse generator from the chain which drives the carriage is not suitable for an accurate control of a flatbed knitting machine.

SUMMARY OF THE INVENTION

It is an object of the present invention to provide a flatbed knitting machine of the type first mentioned above having a pulse generator which makes it possible to achieve control of the machine which is substantially free from mechanical problems, which is accurately synchronised with the needle cycle and which is independent of the gauge or fineness of the pitch of the needle bed.

This is achieved in accordance with one aspect of the present invention by a machine of the type first referred to above comprising an endless drive element stretched on the machine frame in the direction of travel of the carriage between two sprocket wheels, and pick-up means connecting the carriage to the drive element in such a way that the pick-up means moves on a linear taut portion of the drive element at least within the utilisable working region of the pulse generator, with the pulse-initiating disc connected directly and fixedly to one of the sprocket wheels and thereby driven in synchronism with the movement of the carriage over the needle bed by positive linked contact between the carriage and the endless drive element, and with the pulse-initiating disc having a peripheral pulse-initiating pitch corresponding in whole number multiples with the needle pitch. The endless drive element is preferably an endless open-link chain, an endless ball chain, an endless toothed belt or an endless perforated belt.

The endless drive element drives only the pulse-initiating disc and not the carriage, so that it operates with practically no loading on it and one reliably avoids any elongation of the drive element which might arise from loading it with non-uniformly accelerated and braked masses In accordance with another aspect of the invention there is provided a machine of the type first referred to above which comprises a toothed element extending linearly parallel to the direction of travel of the carriage between the points of reversal of the carriage at least within the utilisable working region of the pulse generator, and gear means connected directly and fixedly to the pulse-initiating disc on the carriage meshing positively with the toothed element, with the pulse-initiating disc having a peripheral pulse-initiating pitch which corresponds in whole number multiples with the needle pitch. The toothed element can comprise a taut chain, a toothed rack or a toothed belt. The pulse generator is arranged on the carriage and is driven by the relative movement between the carriage and the stationary toothed element.

With the pulse generator constructed and arranged in accordance with the invention the cycle signallers are not directly controlled by the sequence of grooves and ribs in the needle bed, so that no mechanical problems arise, particularly when the needle bed grooves have a fine pitch. By driving the pulse-initiating disc through positive non-slip contact between carriage and machine frame one safely avoids any errors in the pulse output.

Preferably, two cycle signallers are provided and the pulse-initiating disc is arranged in such a way that the cycle signallers always produce the same logic output for each needle cycle. The pitch of the pulse-initiating disc is made equal to the needle pitch, while the two cycle signallers are arranged circumferentially offset relative to one another by one quarter of the needle pitch. With this arrangement the pulse generator produces exactly one pulse per needle cycle.

In accordance with an alternative embodiment of the invention two cycle signallers are provided and the pulse-initiating disc is constructed in such a way that the logic output of the cycle signallers is different at least for two successive needle bed grooves and repeats itself after a predetermined number of needle bed grooves. Preferably, in this case the pitch of the pulse-initiating disc is four times the needle pitch and the two cycle signallers are arranged circumferentially offset relative to one another by one needle pitch. The pulse-initiating disc in this case functions as a code generator, with the result that a particular logic combination is produced for the two cycle signallers per needle cycle. As a result, the pulse-initiating disc can be made smaller in diameter and with a coarser pitch.

BRIEF DESCRIPTION OF THE DRAWINGS

In order that the invention may be fully understood, a description will now be given of certain preferred embodiments of knitting machine in accordance with the invention, by way of example and with reference to the accompanying drawings, in which.

DESCRIPTION OF THE PREFERRED EMBODIMENT

Figure 1:
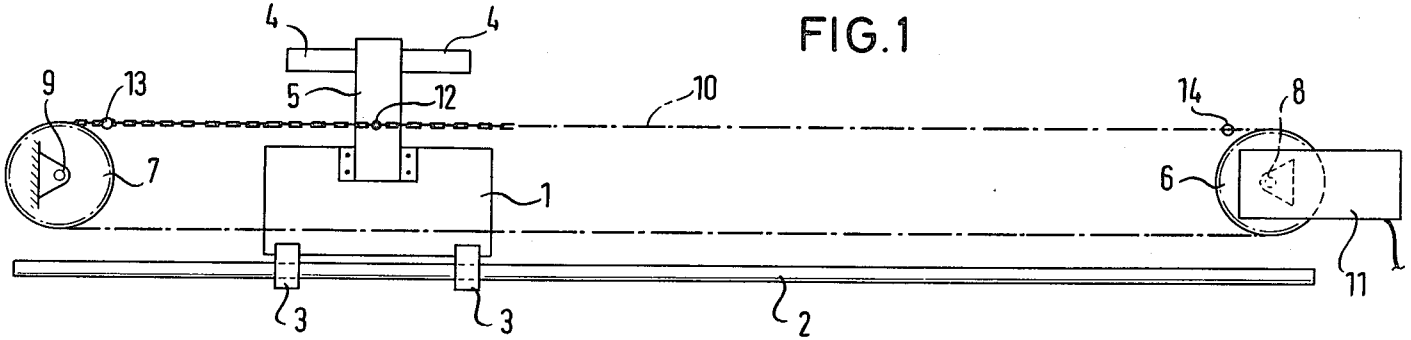
FIG. 1 is a schematic illustration of the carriage and carriage mounting of a flatbed knitting machine which includes a pulse generator on the machine frame and with the drive for the pulse generator being effected by way of an endless chain entrained by the carriage.

FIG. 1 is a schematic representation of a flatbed knitting machine which comprises a carriage 1 which travels along a guide rail 2 fixed to the machine frame. The carriage 1 is mounted on the guide rail 2 by means of carriage mounting 3. Yarn guide pick-up magazines 4 are connected to the carriage by means of a carriage bracket 5. On the machine frame, on both sides of the flatbed knitting machine, are sprocket wheels 6 and 7 mounted on shaft bearings 8 and 9 respectively. An endless chain 10, which is additional to the carriage driving chain, runs around these sprocket wheels 6 and 7. Sprocket wheel 6 is fixedly connected to a pulse-initiating disc of a pulse generator 11. Sprocket wheel 7 is designed to act as a tensioning wheel.

By means of a pick-up 12 mounted on the carriage bracket 5 the endless chain 10 is entrained by the carriage 1 in the linear taut section of the chain between an outermost leftward datum position 13 and an outermost rightward datum position 14. This linear taut section of chain lies within the working zone of the pulse generator 11 which is to be utilised.

The pick-up 12 remains in positive linked contact with the chain 10 within the taut section of the chain between the outermost leftward datum position 13 and the outermost rightward datum position 14. This means that sprocket wheel 6 and the pulse-initiating disc connected to it are driven in synchronism with the traversing movement of the carriage 1. The pitch of the toothing around the periphery of the pulse-initiating disc corresponds in whole number multiples with the spacing, i.e. the pitch of the needles. If the needle pitch is in inches, then the sprocket wheels 6 and 7 have a tooth pitch based upon inches and the endless chain 10 is an inch chain. The endless chain 10 can be formed as an endless open-link chain, as an endless ball chain, as an endless toothed belt or as an endless perforated belt.

Figure 2:
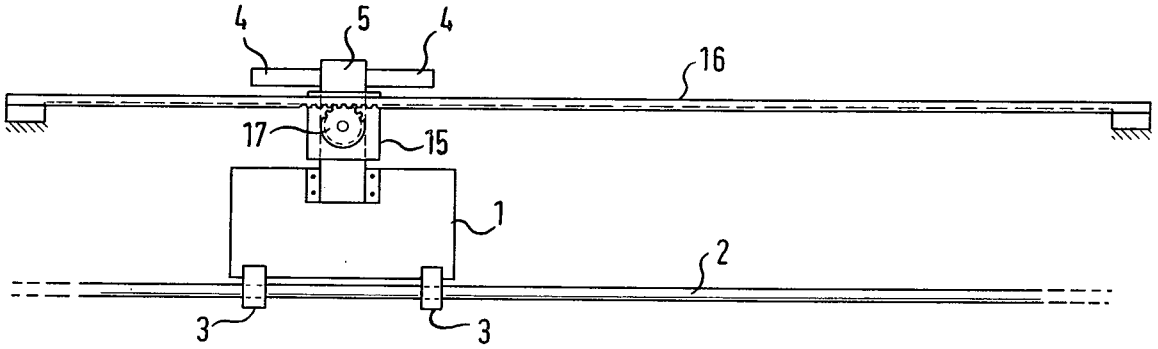
FIG. 2 is a schematic illustration similar to FIG.1, but with the pulse generator here mounted on the carriage and with a stationary rack for the driving of the pulse generator.

In the flatbed knitting machine shown in FIG. 2 there is a pulse generator 15 mounted on the carriage 1 in the region of the carriage bracket 5. A stationary toothed rack 16 is mounted on the machine frame and extends at least over the working region of the pulse generator 15 which is to be utilised. A pulse-initiating disc (not shown) of the pulse generator 15 is driven in synchronism with the movement of the carriage 1 by means of a pinion 17 which moves with the carriage and which meshes positively with the toothed rack 16. Alternatively, instead of the toothed rack 16, one can use a tensioned chain, a toothed belt or any other equivalent means.

In the embodiment illustrated in FIG. 1, the spacing between the axes of the sprocket wheels 6 and 7 is chosen to be at least so large that, as mentioned, the pick-up 12 moves in the linear taut section of the chain to drive the pulse-initiating disc, at least in the working region to be utilised. As the carriage 1 traverses back and forth, the sprocket wheels 6 and 7 perform alternate clockwise and anticlockwise (leftward and rightward) movements, remaining stationary as the carriage movement reverses. The pulse-initiating disc performs the same movements.

Figure 3:
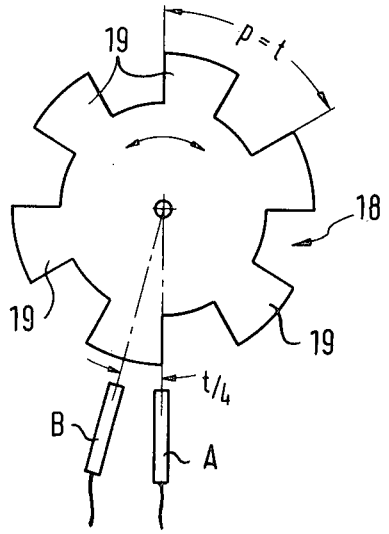
FIG. 3 is a schematic representation of a pulse generator comprising a pulse-initiating disc, shown in plan view, and two cycle signallers.
Figure 3:
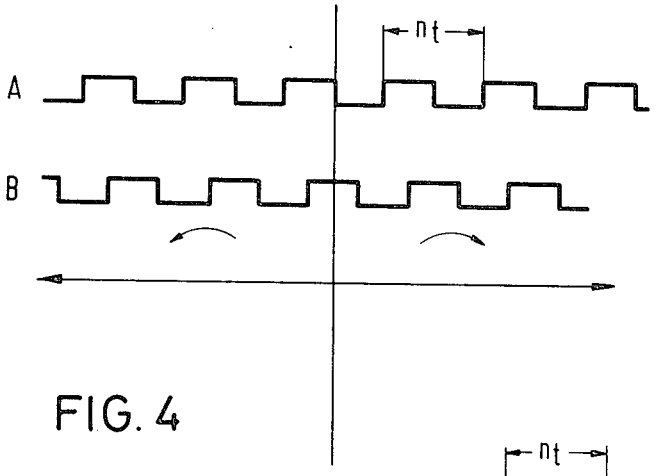

In FIG. 3 there is shown a pulse-initiating disc 18 with teeth 19. The pitch p of the teeth 19 around the circumference of the pulse-initiating disc 18 is exactly equal to one needle pitch t in the needle bed. Two cycle signallers A and B are positioned adjacent to the periphery of the pulse-initiating disc 18 and are arranged to be circumferentially spaced from one another by one quarter of the needle pitch t/4. The pulse-initiating disc 18 is seated fixedly on the same shaft as the sprocket wheel 6 (FIG. 1) or the pinion 17 (FIG. 2) and thus is driven in synchronism with this wheel or pinion and consequently in synchronism with the movement of the carriage 1 within the working region of the pulse generator which is to be utilised. This means that the pulse-initiating disc advances by exactly one tooth plus tooth gap (pitch p of the pulse-initiating disc) when the carriage 1 is displaced by a distance equal to one needle pitch t.

Figure 4:
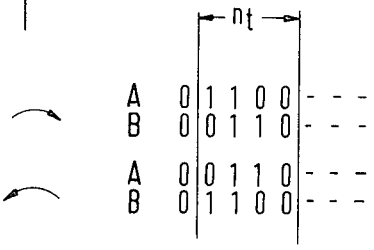
FIG. 4 shows the pulse sequence produced by the pulse-initiating disc shown in FIG. 3, and also a Table for the signalled cycle sequence.
Figure 5:
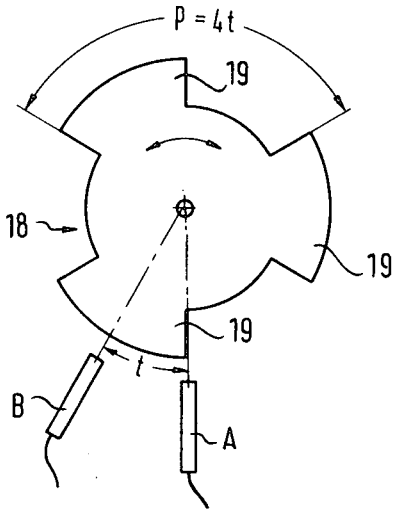
FIG. 5 is a schematic illustration, similar to FIG. 3, showing an alternative form of pulse-initiating disc; and, FIG. 6 shows the pulse sequence and the signalled cycle sequence for the pulse-initiating disc shown in FIG. 5.

The upper part of FIG. 4 reproduces the pulse sequence for the cycle signallers A and B which occurs with clockwise and anticlockwise movement of the pulse-initiating disc 18. One pulse period corresponds exactly to one needle cycle $n_t$. The vertical centre-line corresponds to the position of the pulse-initiating disc 18 which is shown in FIG. 3. The lower portion of FIG. 4 shows the logic coding for the cycle signallers A and B in combination with the pulse-initiating disc 18 for rightward movement and leftward movement of the carriage. When the carriage is displaced by a distance equal to one needle cycle $n_t$, the cycle signallers A and B go through a total of four different switching state combinations. FIG. 5 shows an alternative form of pulse-initiating disc 18 with teeth 19 which work as a code signaller. The pitch p at the circumference of this pulse-initiating disc 18 is exactly equal to four times the needle pitch t. The cycle signallers A and B are offset relative to one another by one needle pitch t and are mounted on a support plate adjacent to the circumference of the pulse-initiating disc 18.

Figure 6:
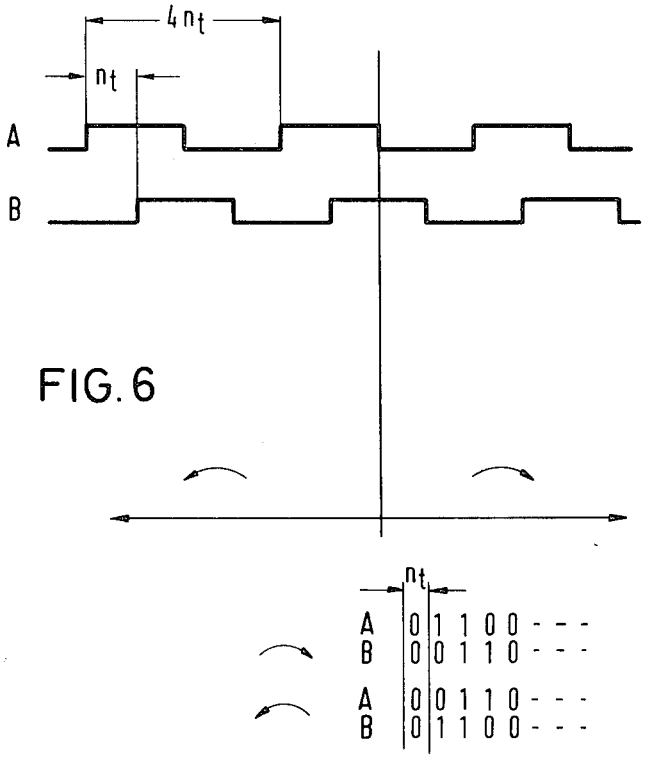

The pulse sequence for the cycle signallers A and B is shown in the upper portion of FIG. 6 for the respective directions of rotation of the disc 18 as indicated by the directions of the arrows. The period of the pulses corresponds to four needle cycles $n_t$.

The lower portion of FIG. 6 shows the logic coding of the cycle signallers A and B. From this it can be seen that in this embodiment only one particular logic combination for the signallers A and B is produced per needle cycle. Consequently, one logic combination corresponds to one needle cycle.

The difference between the pulse-initiating discs or pulse generators shown in FIGS. 3 and 5 is that the teeth of the disc 18 of FIG. 5 can be made four times as coarse as those of the disc 18 of FIG. 3. This means that, because one cannot have an unlimitedly small tooth shape, the external diameter of the disc 18 in the embodiment of FIG. 3 must be chosen to be larger than that in the embodiment of FIG. 5, the pitch of the endless chain 10 or of the rack 16 must be chosen to be small and the number of teeth on the sprocket wheels 6 and 7 or on the pinion 17 must likewise be chosen to be small. The pulse generator with a pulse-initiating disc 18 and with the cycle signallers A and B arranged as in FIG. 5 can function with a coarser chain pitch or rack pitch, with sprocket wheels 6 and 7 or pinion 17 with more teeth, and with a smaller diameter pulse initiating disc 18. Overall, this results in a more robust mechanical structure which is less subject to wear and tear and consequently has a longer life expectancy and ensures better functioning of the pulse generator and of its drive.

I claim:

1. In a high capacity, automatic, flatbed knitting machine comprising a cam carriage movable back and forth over a needle bed, a pulse generator which comprises a pulse-initiating disc and two cycle signallers at the circumference of the disc and which produces pulses corresponding to the needle cycle for the electronic control of the machine, the improvement comprising: an endless chain stretched on the machine frame in the direction of travel of the carriage between two sprocket wheels, and pick-up means connecting the carriage being driven by a separate drive chain to the endless chain in such a way that the pick-up means moves on a linear taut portion of the endless chain at least within the utilisable working region of the pulse generator, the pulse-initiating disc being connected directly and fixedly to one of the sprocket wheels and thereby driven in synchronism with the movement of the carriage over the needle bed by a positive linked contact between the carriage and the endless chain, said pulse-initiating disc having a peripheral pulse-initiating pitch corresponding in whole number multiples with the pitch of needles mounted on the bed, and said endless chain driving exclusively the pulse-initiating disc.

2. A flatbed knitting machine in accordance with claim 1, wherein the pulse-initiating disc is geometrically configured relative to the mounting of the cycle signallers such that said signallers produce a logic output which is different at least for two successive needle bed grooves and which repeats itself after a predetermined number of needle bed grooves.

3. A flatbed knitting machine in accordance with claim 2, in which the pitch of the pulse-initiating disc is four times the needle pitch and the two cycle signallers are arranged circumferentially offset relative to one another by an amount equal to one needle pitch.

* * * * *